US008845217B2

(12) United States Patent
Ogasawara et al.

(10) Patent No.: US 8,845,217 B2
(45) Date of Patent: Sep. 30, 2014

(54) PRINTING APPARATUS

(75) Inventors: Seiji Ogasawara, Machida (JP); Shimpei Shinohara, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 244 days.

(21) Appl. No.: 13/215,697

(22) Filed: Aug. 23, 2011

(65) Prior Publication Data

US 2012/0051825 A1 Mar. 1, 2012

(30) Foreign Application Priority Data

Aug. 26, 2010 (JP) ..... 2010-189705

(51) Int. Cl.
*B41J 13/02* (2006.01)
*B65H 5/06* (2006.01)

(52) U.S. Cl.
CPC ..... *B41J 13/025* (2013.01); *B65H 5/062* (2013.01); *B65H 5/06* (2013.01); *B65H 2404/1431* (2013.01); *B65H 2402/545* (2013.01); *B65H 2404/134* (2013.01)
USPC ..... 400/645; 347/104; 400/578

(58) Field of Classification Search
USPC ..... 347/104; 400/645
See application file for complete search history.

(56) References Cited

U.S. PATENT DOCUMENTS

| | | | | | |
|---|---|---|---|---|---|
| 5,540,427 | A * | 7/1996 | Nitta et al. | 271/274 |
| 5,725,319 | A | 3/1998 | Saito et al. | |
| 5,734,404 | A * | 3/1998 | Komuro et al. | 347/104 |
| 5,800,076 | A * | 9/1998 | Umeda | 400/645.3 |
| 5,899,613 | A | 5/1999 | Koike et al. | |
| 6,089,773 | A * | 7/2000 | Bailey et al. | 400/642 |
| 6,332,664 | B1 * | 12/2001 | Kanazawa | 347/19 |
| 6,536,896 | B1 * | 3/2003 | Kan | 347/104 |
| 6,641,250 | B2 * | 11/2003 | Saito | 347/31 |
| 6,719,393 | B2 * | 4/2004 | Uchida | 347/16 |
| 6,733,009 | B2 | 5/2004 | Ogasawara | |
| 6,883,909 | B2 * | 4/2005 | Kanazawa et al. | 347/104 |
| 6,957,887 | B2 * | 10/2005 | Bruhn | 347/104 |
| 2002/0021342 | A1 * | 2/2002 | Kawazoe et al. | 347/104 |
| 2002/0101492 | A1 * | 8/2002 | Hierro et al. | 347/104 |
| 2003/0025777 | A1 * | 2/2003 | Sugiyama | 347/104 |
| 2003/0048945 | A1 * | 3/2003 | Tamagawa | 382/167 |
| 2004/0007810 | A1 * | 1/2004 | Shinmachi et al. | 271/272 |

FOREIGN PATENT DOCUMENTS

| | | | | |
|---|---|---|---|---|
| JP | 06-135590 | | 5/1994 | |
| JP | 09-156799 | A | 6/1997 | |
| JP | 2006-044938 | A | 2/2006 | |
| JP | 2009-184774 | A | 8/2009 | |
| JP | 2009184774 | A * | 8/2009 | B65H 5/06 |

* cited by examiner

*Primary Examiner* — Nguyen Ha
(74) *Attorney, Agent, or Firm* — Fitzpatrick, Cella, Harper & Scinto

(57) ABSTRACT

A printing apparatus capable of maintaining print sheet conveying performance while keeping apparatus cost low and apparatus size small is provided. The printing apparatus includes a conveying mechanism and a print unit. The conveying mechanism includes a conveying roller which is a driving roller, a plurality of pinch rollers which are passive rollers disposed facing the conveying roller, and a plurality of pinch roller axles supporting the pinch rollers. The print unit prints onto a sheet conveyed by the conveying rollers and the plurality of pinch rollers. The conveying mechanism includes one or more first pinch roller sets including two pinch rollers and a first pinch roller axle supporting the two pinch rollers, and one or more second pinch roller sets including three pinch rollers and a second pinch roller axle supporting the three pinch rollers.

14 Claims, 11 Drawing Sheets

PRINTING APPARATUS

BACKGROUND OF THE INVENTION

1. Field of the Invention

The present invention relates to a printing apparatus such as a printer.

2. Description of the Related Art

Heretofore, a configuration wherein a sheet is conveyed while being held between a conveying roller that rotates under driving from a motor and a pinch roller (a passively driven roller) has been typical for printing apparatus, and several proposals have been made for detailed configurations thereof. For example, as disclosed in Japanese Patent Laid-Open No. H06-135590 (1994), an urging mechanism is provided wherein the center in the widthwise direction of a pinch roller is supported by a supporter, and the supporter urges the pinch roller towards the conveying roller at the widthwise center of the pinch roller. In so doing, pressing force of the pinch roller onto the conveying roller is made uniform, and the effects of pressure force variations due to age deformation of the support mechanism can be suppressed.

In the case of modifying the printing apparatus disclosed in the above literature to a printing apparatus in which the compatible print sheet width has been changed (for example, in the case of modifying an A3 compatible apparatus to a Super A3 or 14"×17" compatible apparatus), passive roller sets consisting of two pinch rollers and one pinch roller axle are increased or decreased with respect to a conveying reference in the widthwise direction of the print sheet. At this point, there is no problem if the increase or decrease in the width of the corresponding print sheet is equivalent to an even number of pinch rollers from the conveying reference of the print sheet, but if equivalent to an odd number, pinch rollers are added unnecessarily, which inflates cost and increase apparatus size.

Also, while disposing an even number of small pinch rollers at the ends does not affect the apparatus size, higher costs are unavoidable due to the necessity of two types of pinch rollers. Furthermore, if it is attempted to modify and redesign the pinch roller such that an even number of pinch rollers fits in the corresponding print sheet width, it becomes difficult to suitably press the lateral edges of various fixed sizes of print sheets with pinch rollers of the same size.

In contrast, if the pinch rollers are not increased, the lateral edges of wide print sheets are not pressed by the pinch rollers, and in cases such as when the lateral edges of a print sheet curl back towards the print head, the sheet rubs against the carriage mounting the print head, causing ink smudges on its surface. In severe cases this can even cause jams.

SUMMARY OF THE INVENTION

An object of the present invention is to provide a printing apparatus able to maintain print sheet conveying performance while keeping apparatus cost low and apparatus size small.

According to the present invention, a print apparatus is obtained whereby print sheet conveying performance is maintained while keeping apparatus cost low and apparatus size small.

Further features of the present invention will become apparent from the following description of exemplary embodiments (with reference to the attached drawings).

DESCRIPTION OF THE EMBODIMENTS

Hereinafter, ideal embodiments of the present invention will be explained in detail and with reference to the drawings by way of example.

First Embodiment

A printing apparatus in accordance with a first embodiment of the present invention will be explained. However, an inkjet printing apparatus (hereinafter, printing apparatus) in accordance with a first embodiment of the present invention may not only be applied to a PC printer, but also to a multifunction printer having copy functions, facsimile functions, etc.

Figure 1:
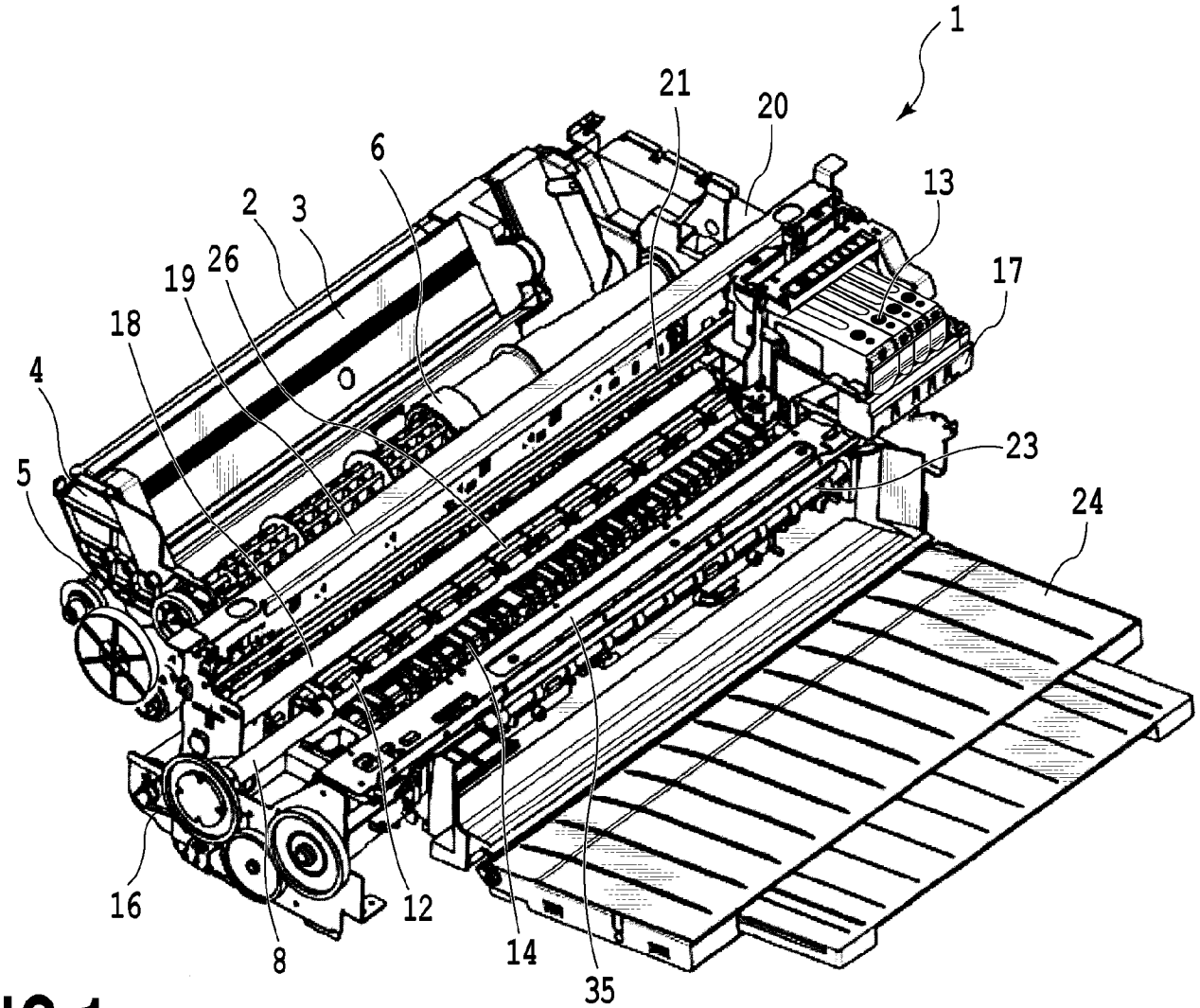
FIG. 1 is a perspective view of a printing apparatus in accordance with a first embodiment of the present invention.
Figure 2:
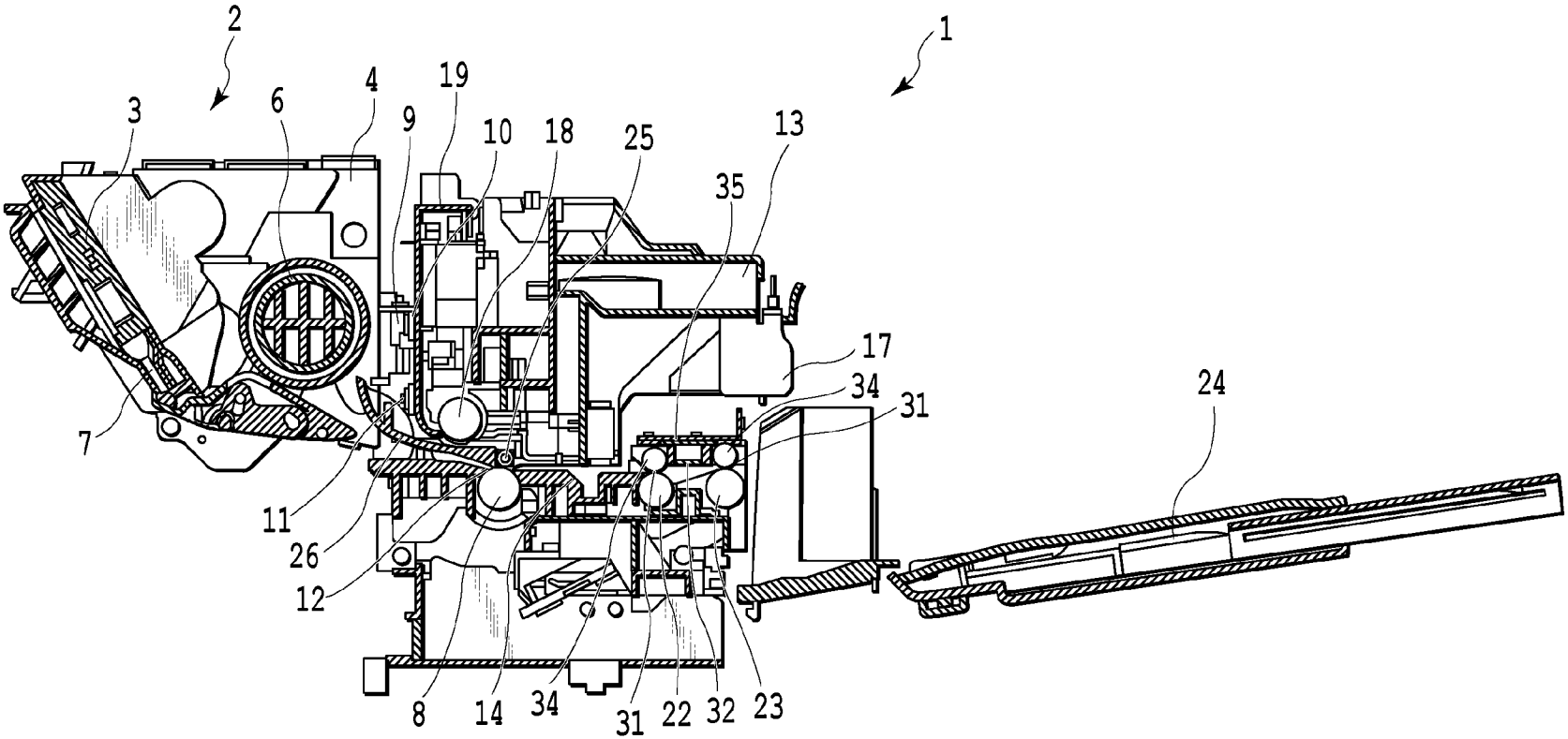
FIG. 2 is a lateral cross section of the printing apparatus in FIG. 1.

First, a summary of the overall apparatus will be given. FIG. 1 is a perspective view illustrating an overall view of a printing apparatus given by the first embodiment of the present invention, while FIG. 2 is a lateral cross section.

1 is the printing apparatus. The pressure plate 3 of a feed apparatus 2 is rotatably supported by a feed apparatus framework 4, and a sheaf of print sheets is stacked upon its top surface. It is possible to use print sheets selected from a plurality of sizes, with the widthwise center of the respective sizes being set so as to coincide with the same position on the pressure plate 3 (this is typically called the center reference).

When feeding a print sheet, a feed roller 6 is rotated by a feed motor 5 acting as a driving source while the pressure plate 3 turns towards the feed roller 6 due to a pressure plate spring 7, pushing the sheaf of print sheets into the feed roller 6. Furthermore, by rotating the feed roller 6, only the topmost print sheet of the sheaf of print sheets is separated and conveyed downstream.

A print sheet separated and conveyed by the feed apparatus 2 is conveyed to a conveying roller 8 (a driving roller) by additional rotation of the feed roller 6. At this point, the leading edge of the print sheet separated and conveyed by the feed apparatus 2 pushes a sensor lever 9 disposed between the feed roller 6 and the conveying roller 8. This causes the sensor lever 9 to rotate, and the leading edge of the print sheet is detected by the sensor lever 9 clearing a sheet sensor 10. Also, detection of the trailing edge of the print sheet is conducted by the sensor lever 9 entering the sheet sensor 10. In the case where the conveying reference is a center reference, the sensor lever 9 is disposed near-center in the widthwise direction of the print sheet so that detection by the sensor lever 9 becomes possible even for narrow print sheets.

Additionally, based on the detection results for the leading edge of the print sheet, the print sheet is conveyed a given amount by the feed roller 6 and made to collide with a conveying roller nip formed by contact between the conveying roller 8 and pinch rollers 12 which are urged towards the conveying roller 8 by pinch roller springs 11. The pinch rollers 12 are typically molds of highly slidable plastic, or molds (compounds) of a highly slidable plastic covered by an elastomer (rubber) or PFA tube around its outer circumference.

After that, the leading edge of the print sheet is curved by being additionally conveyed by the feed roller 6. The leading edge of the print sheet is pushed into the conveying roller nip, and resist operation ends. At this point, in order to keep the spacing constant between the print sheet and the surface of the print head 13 where the printing elements are arrayed, the conveying roller nip is positioned above the surface of a platen 14 by a given amount, and the center of the pinch rollers 12 is offset downstream from the center of the conveying roller 8. The resulting configuration pushes the print sheet towards the surface of the platen 14.

After finishing resist operation, the print sheet is conveyed on the platen 14 by the conveying roller 8 and held on the surface of the platen 14 at a position facing the surface of the print head 13 where the printing elements are arrayed. The conveying roller 8 is rotated by a conveying motor 15 acting as a driving source via a conveying roller timing belt 16.

Subsequently, printing is conducted by scanning the carriage 17 while ejecting ink droplets onto the print sheet being supported on the surface of the platen 14 from the print head 13 mounted on the carriage 17. The carriage 17 is supported by a guide axle 18 and a guide rail 19 so as to be able to scan, and is driven by driving from a carriage motor 20 via a carriage timing belt 21.

The print head 13 is provided with microscopic liquid ejection ports (orifices), channels, energy action parts provided along a portion of the channels, and energy production sources which produce droplet-forming energy exerted on liquid in the energy action parts. An energy production source that produces such energy may be printing methods that use an electromechanical converter such as a piezo element, printing methods that use an energy producing source which generates heat by radiating electromagnetic waves such as a laser and causes droplets to be ejected by the action given by the heat, or printing methods that use an energy producing source which applies heat to liquid by means of an electrothermal converter such as a heater element including a heating resistor, for example.

In print head using inkjet printing methods that cause liquid to be ejected by means of thermal energy, liquid ejection ports (orifices)) for forming ejection droplets by ejecting droplets for printing can be densely arrayed, and high-resolution printing is possible. Among these, a print head that uses an electrothermal converter as an energy producing source is easily made compact, and can also fully utilize the strengths of IC technologies and micro fabrication technologies, which have yielded remarkable technological advancements and reliability in the semiconductor field recently. For these reasons, it is easy to densely package such a print head, and its manufacturing cost is low.

Additionally, a print sheet finished with printing by repeated convey by the conveying roller 8 and scanning of the carriage 17 is discharged into a delivery tray 24 by a downstream delivery roller 23 and upstream delivery roller 22, and by spurs 34 urged by these individual rollers. The spurs 34 are urged by spur springs 31 provided as coil springs in a rod shape, and are rotatably supported by a spur holder 32.

Herein, driving force from the conveying roller 8 is transmitted to the downstream delivery roller 23 and the upstream delivery roller 22 by a gear train, etc. Also, in order to suppress bending of a thinned gear holder 32 due to size reduction of the printing apparatus 1, a metal stiffener 35 is provided.

Figure 3:
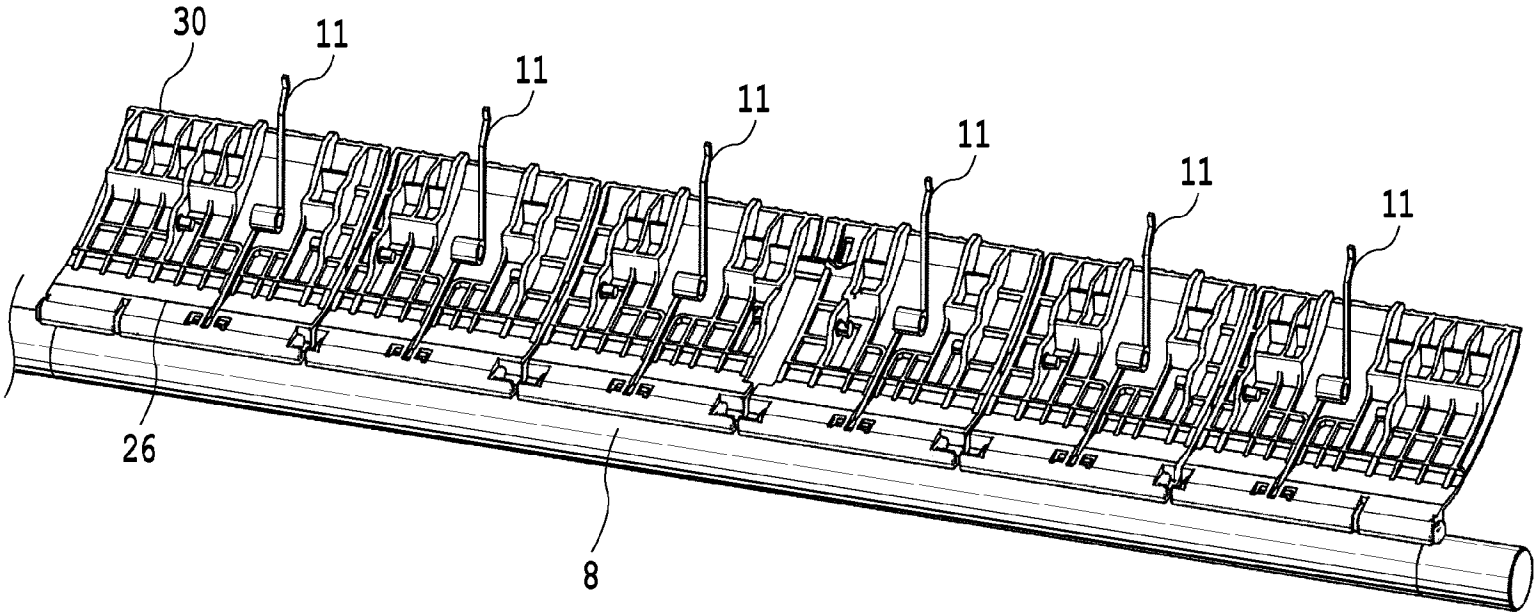
FIG. 3 is a perspective view illustrating the vicinity of the conveying roller in the printing apparatus in FIG. 1.
Figure 4:
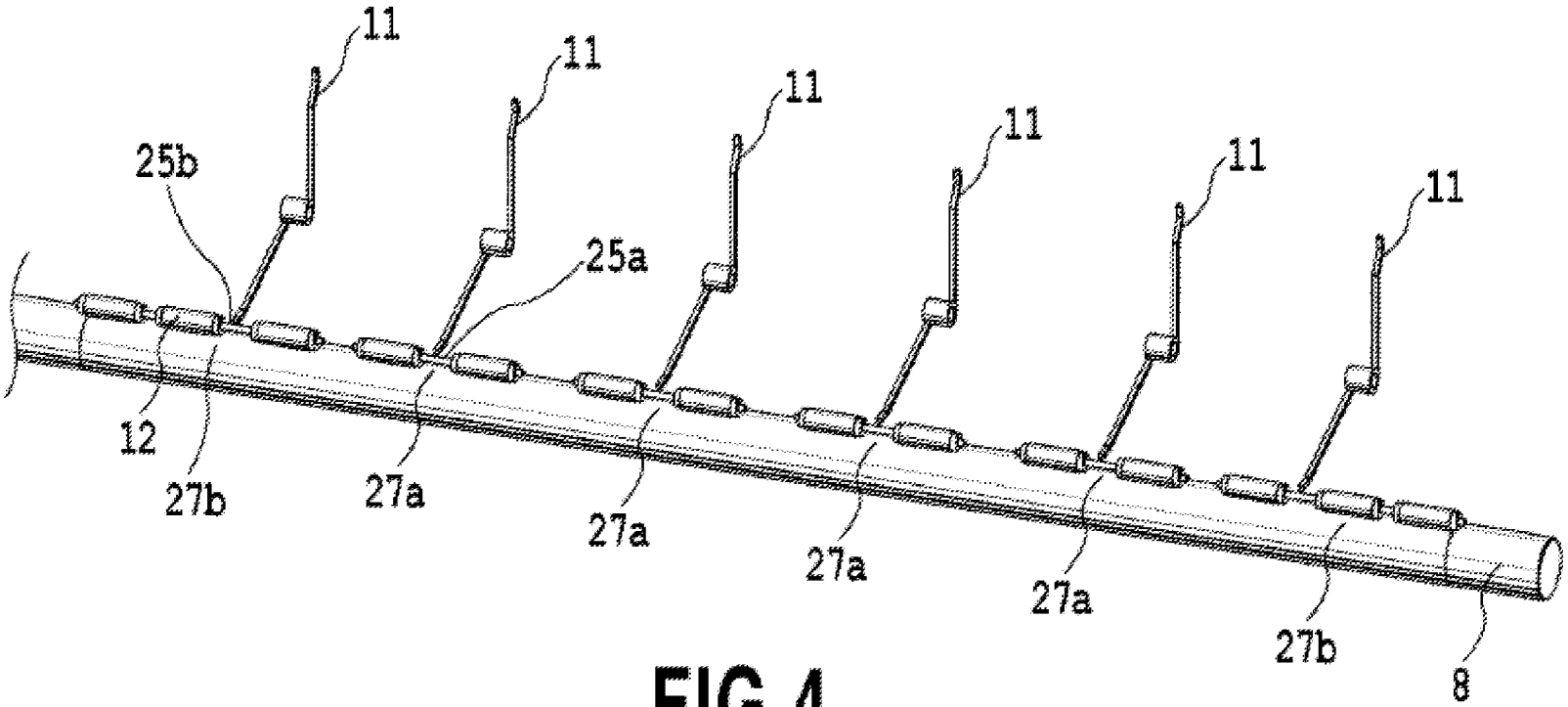
FIG. 4 is a perspective view illustrating a pinch roller configuration in the printing apparatus in FIG. 1.

Subsequently, placement of the pinch rollers 12 will be explained in detail using FIGS. 3 to 9. FIG. 3 illustrates pinch roller springs 11 and a pinch roller unit 30 in which the conveying roller 8 and pinch rollers 12 (passive rollers) are built-in. Also, FIG. 4 is a diagram with the pinch roller holder 26 which acts as a pinch roller axle support mechanism removed in order to more easily understand the placement of the pinch rollers 12, the pinch roller axles, and the pinch roller springs 11.

A first pinch roller set (a first pinch roller assembly) 27*a* is made up of two pinch rollers 12, a short pinch roller axle (first pinch roller axle) 25*a* rotatably supporting these two pinch rollers 12. The first pinch roller set is assembled with the two pinch rollers and the first pinch roller axle. A plurality of first pinch roller sets 27*a* are disposed from the widthwise center of the print sheet outwards such that each pinch 12 is disposed on the same axis line.

A second pinch roller set (a second pinch roller assembly) 27*b* is disposed on the ends in the widthwise direction of the print sheet, and is made up of three pinch rollers 12 and a long pinch roller axle (second pinch roller axle) 25*b* rotatably supporting these three pinch rollers 12. The second pinch roller set is assembled with the three pinch rollers and the second pinch roller axle.

Figure 5:
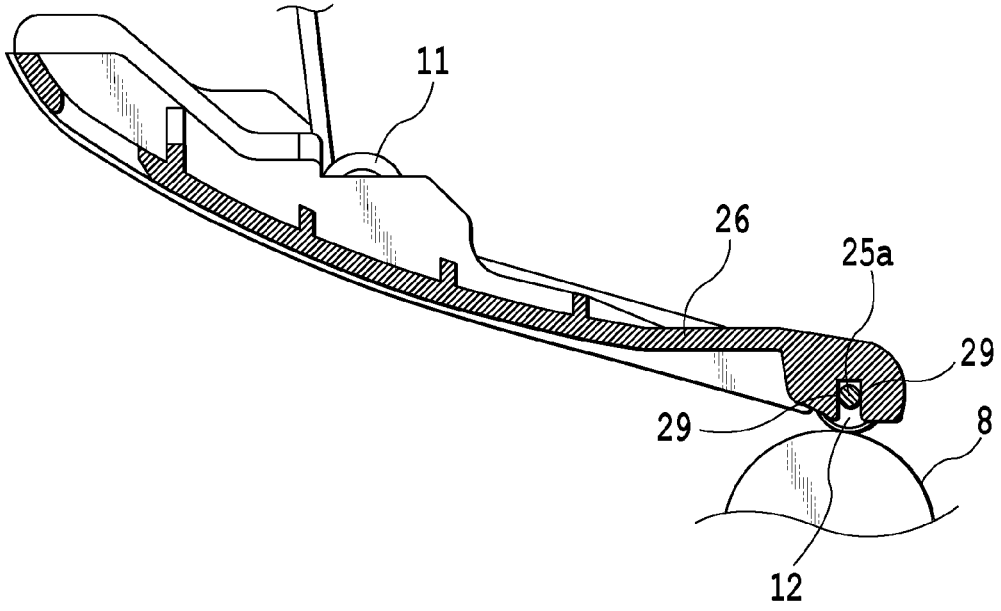
FIG. 5 is a lateral cross section of the vicinity of the edge of a pinch roller axle in the printing apparatus in FIG. 1.

Herein, both ends of the short pinch roller axle 25*a* in the first pinch roller set 27*a* are supported by movement restrictors (supporters) 29 formed on the pinch roller holder 26 and disposed facing each other having a slight gap in the conveying direction of the print sheet, as illustrated in FIG. 5. Also, a sufficient gap is provided above the short pinch roller axle 25*a* between it and the pinch roller holder 26, such that the short pinch roller axle 25*a* and the pinch roller holder 26 do not come into contact.

Figure 6:
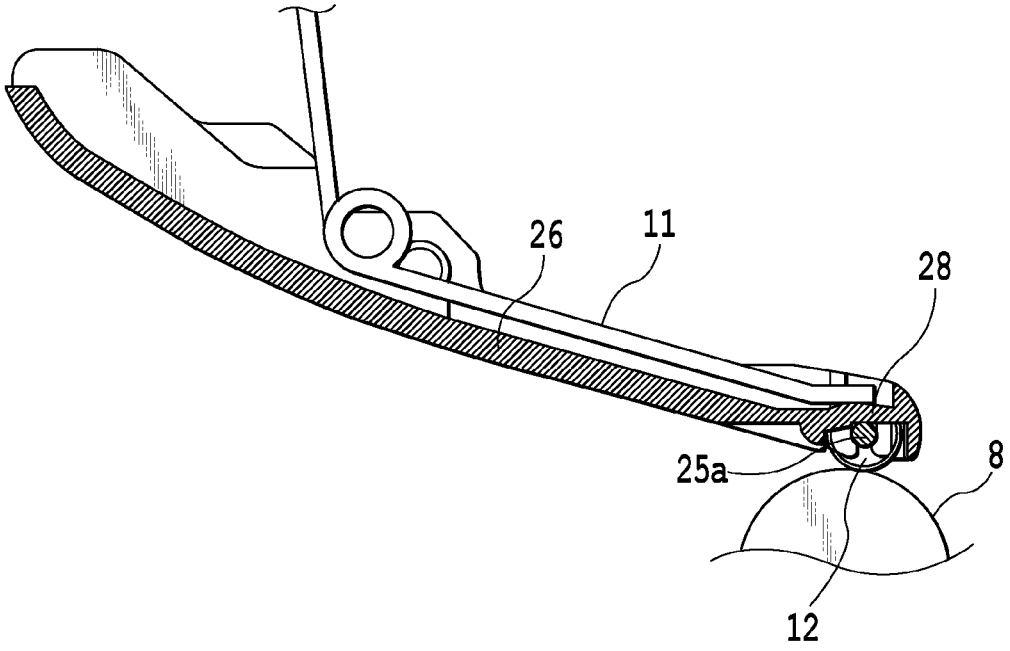
FIG. 6 is a lateral cross section of the vicinity of the pressing part of a pinch roller axle in the printing apparatus in FIG. 1.

Also, as illustrated in FIG. 6, the short pinch roller axle 25*a* contacts a contact portion 28 which is a part of the pinch roller holder 26 in the portion between the two pinch rollers 12. Furthermore, by pressing a pinch roller spring 11 on the back surface part of the contact portion 28 of the pinch roller holder 26, the pinch rollers 12 are urged towards the conveying roller 8 via the short pinch roller axle 25*a*. According to this configuration, the short pinch roller axle 25*a* is kept parallel with the axis line of the conveying roller 8, and even if some bending or other deformation occurs in the plastic pinch roller holder 26, the pressing force of the pinch roller spring 11 is applied evenly to the two pinch rollers 12 without being lessened.

Meanwhile, in the second pinch roller set 27*b*, both ends of the long pinch roller axle 25*b* are held by movement restrictors (supporters) 29 formed on the pinch roller holder 26 and disposed facing each other having a slight gap in the conveying direction of the print sheet, similarly to the first pinch roller set 27*a*. Also, a sufficient gap is provided above the long pinch roller axle 25*b* between it and the pinch roller holder 26, such that the long pinch roller axle 25*b* and the pinch roller holder 26 do not come into contact. Additionally, the long pinch roller axle 25*b* contacts a contact portion 28 which is a part of the pinch roller holder 26 in the portion between the two pinch rollers 12 closer to the center in the widthwise direction of the print sheet from among the three pinch rollers 12, similarly to the first pinch roller set 27*a*. Furthermore, by pressing a pinch roller spring 11 on the back surface part of the contact portion 28 of the pinch roller holder 26, the pinch rollers 12 are urged towards the conveying roller 8 via the long pinch roller axle 25*b*.

Figure 7:
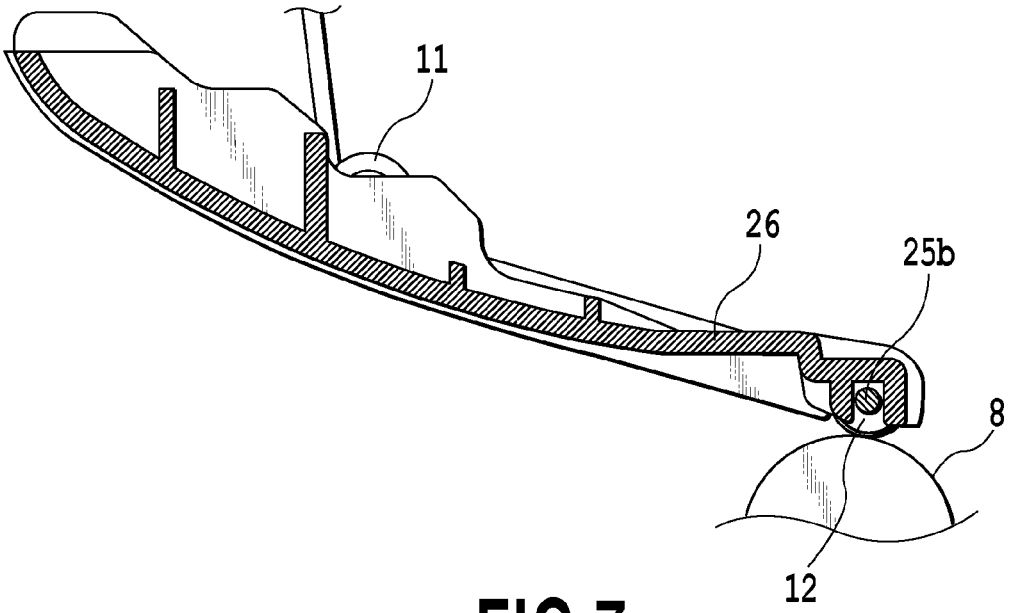
FIG. 7 is a lateral cross section of the vicinity of a non-contacting part of a pinch roller axle in the printing apparatus in FIG. 1.
Figure 9:
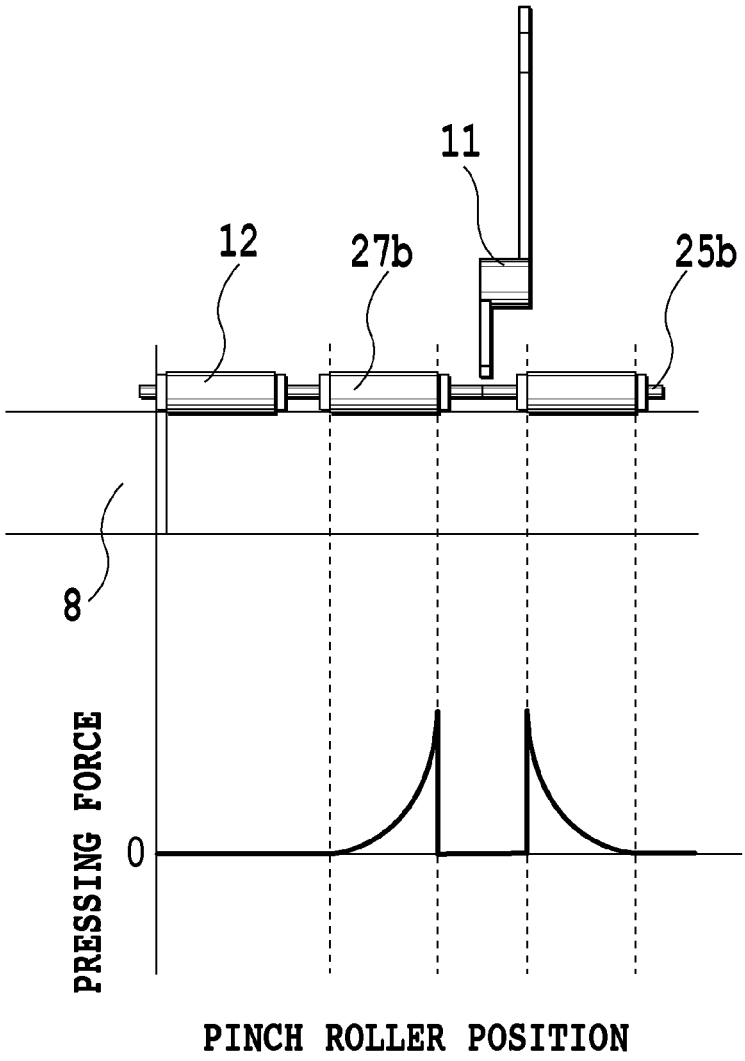
FIG. 9 illustrates the pressing state of a second pinch roller set in the printing apparatus in FIG. 1.

At this point, since the long pinch roller axle 25*b* is slightly deformed in an approximate V shape as illustrated in FIG. 9 due to the pressing force of the pinch roller springs 11, almost all of the pressing force is exerted upon the two pinch rollers 12 positioned on either side of the contact portion 28. Also, as illustrated in FIG. 7, the long pinch roller axle 25*b* is provided with a sufficient gap between it and the pinch roller holder 26 both above and in the conveying direction of the print sheet in the portion between the two pinch rollers 12 on the outward side in the widthwise direction of the print sheet from among the three pinch rollers 12. For this reason, the long pinch roller axle 25*b* does not come into contact with the pinch roller holder 26. In so doing, the axis line of the long pinch roller 25*b* is kept parallel with the conveying roller 8. Moreover, even if some bending or other deformation occurs in the plastic pinch roller holder 26, the pressing force of the pinch roller spring 11 is applied evenly to the two pinch rollers 12 closer to the center in the widthwise direction of the print sheet without being lessened.

Figure 8:
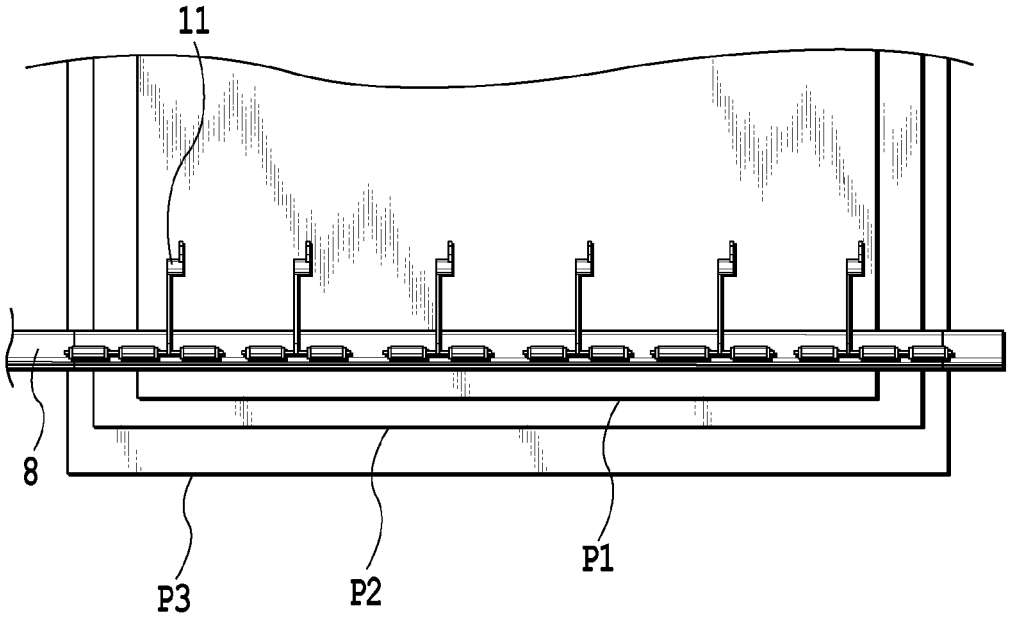
FIG. 8 is a schematic diagram illustrating the positional relationship between a print sheet and pinch rollers in the printing apparatus in FIG. 1.

FIG. 9 illustrates a pressing force distribution of the pinch rollers 12 applied to the conveying roller 8 in the second pinch roller set 27*b*. Among the three pinch rollers 12, the pinch roller 12 positioned farthest outward in the widthwise direction of the print sheet applies almost no pressing force onto the conveying roller 8, and thus produces almost no conveying force with respect to the print sheet. As illustrated in FIG. 8, the sizes of print sheets pressed by this pinch roller 12 are only a 14"×17" print sheet P3 and a Super A3 print sheet P2, and it is sufficient to have a conveying force able to convey a relatively small A3 print sheet P1. However, unless a pinch roller 12 exists at the lateral edges of a 14"×17" print sheet P3, the lateral edges may rise upward and contact the carriage 17 including the print head 13, and there is a possibility that the print sheet may be dirtied or damaged. Thus, it becomes necessary to dispose pinch roller 12*s* that, although not having conveying force, keep the lateral edges of the print sheet from rising.

Consider the case where the long pinch roller axle 25*b* is SUS-manufactured with a diameter of 1.6 mm, the urging force of a pinch roller spring 11 is 5.88 N, and it is attempted to keep sheet rising to approximately 0.5 mm. In this case, it is preferable to dispose pinch rollers 12 within approximately 50 mm from the contact portion 28 in consideration of deformation of the long pinch roller axle 25*b*.

Furthermore, if a slightly risen pinch roller 12 is disposed farthest outward in the widthwise direction of the print sheet, the risen print sheet at that portion will be trapped, and the print sheet may ripple in the widthwise direction as it is conveyed and may contact the carriage 17 including the print head 13. In severe cases this can even cause jams. For this reason, a second pinch roller set 27*b* made up of three pinch rollers 12 in the present embodiment is allowed to be disposed only at either end in the widthwise direction of the print sheet.

Also, for cost reasons it is preferable to use the respectively same components for the pinch rollers 12 and the pinch roller springs 11. Since the short pinch roller axle 25*a* and the long pinch roller axle 25*b* have the same material and diameter and only differ in length, this does not become a large cost-increasing factor.

According to the present embodiment, in the case of modifying an existing A3 compatible apparatus to a 14"×17" compatible apparatus, the first pinch roller sets 27*a* at either end in the widthwise direction of the print sheet may simply be changed to second pinch rollers sets 27*b* in the pinch roller unit 30.

According to the above configuration and action, it becomes possible to provide a printing apparatus that maintains print sheet conveying performance while keeping apparatus cost low and without unnecessarily increasing apparatus size.

Second Embodiment

Figure 10:
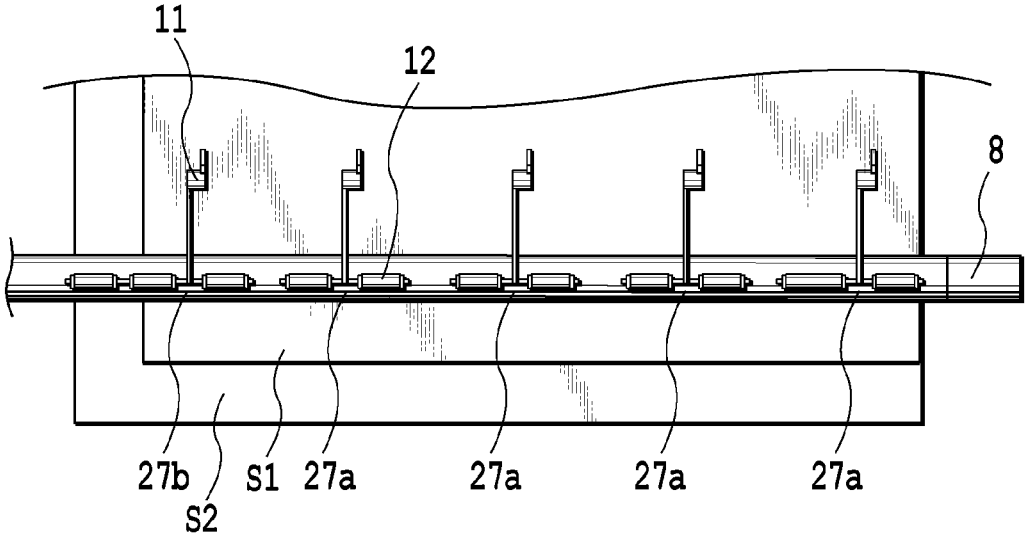
FIG. 10 is a perspective view illustrating a pinch roller configuration in a printing apparatus in accordance with a second embodiment of the present invention.

In the printing apparatus of the present embodiment, a second pinch roller set 27*b* is disposed only on the non-reference end, as illustrated in FIG. 10. This printing apparatus is able to selectively use a plurality of sizes of print sheets S1 and S2, has a one-sided reference, and the edges on one side of the sheets of respective sizes are set at the same position on the pressure plate 3. In other words, in the present embodiment, by disposing a second pinch roller set 27*b* only on the non-reference end, advantages similar to those of the first embodiment are obtained.

Third Embodiment

Figure 11:
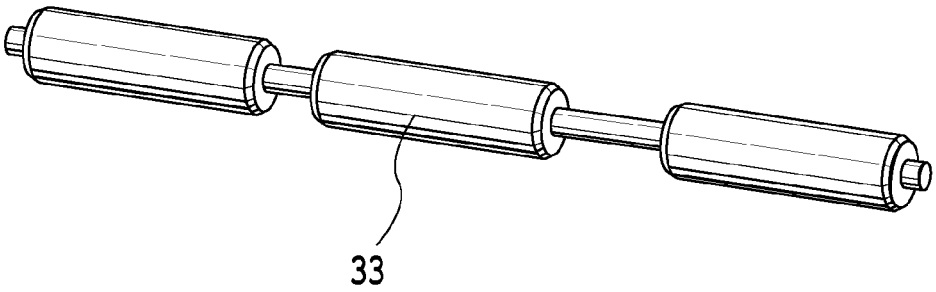
FIG. 11 is a perspective view illustrating a pinch roller in a printing apparatus in accordance with a third embodiment of the present invention.

The two pinch rollers 12 and short pinch roller axle 25*a* of the first pinch roller set 27*a* and the three pinch rollers 12 and long pinch roller axle 25*b* of the second pinch roller set 27*b* of the first or second embodiment may also be taken to be integrally formed plastic or metal molds as illustrated by 33 in FIG. 11. In so doing, advantages similar to those of the first embodiment are obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-189705, filed Aug. 26, 2010, which is hereby incorporated by reference herein in its entirety.

What is claimed is:

1. A printing apparatus, comprising:

a conveying mechanism that includes a conveying roller being a driving roller, a plurality of pinch rollers being passive rollers disposed facing the conveying roller, and a plurality of pinch roller axles supporting the pinch rollers; and a print unit that prints onto a sheet conveyed by the conveying rollers and the plurality of pinch rollers, wherein the conveying mechanism comprises a first pinch roller set including two pinch rollers and a first pinch roller axle supporting the two pinch rollers;

a second pinch roller set including three pinch rollers and a second pinch roller axle supporting the three pinch rollers, wherein the pinch rollers all have the same structures; and an urging unit configured to urge a portion of the second pinch roller axle so as to push the three pinch rollers towards the conveying roller via the second pinch roller axle, wherein said portion of the second pinch roller axle is between two pinch rollers of the three pinch rollers and is disposed closer to the center in the widthwise direction of the sheet from among the three pinch rollers.

2. The printing apparatus according to claim 1, wherein the conveying mechanism comprises a pinch roller axle support mechanism including supports that rotatably support two sides on the first and second pinch roller axles, respectively, in the sheet conveying direction, and a contact portion that contacts each of the pinch roller axles at a portion between the plurality of pinch rollers, and the urging unit urges the contact portion so as to push the pinch rollers towards the conveying roller via the pinch roller axles.

3. The printing apparatus according to claim 1, wherein supports are provided on either end of the pinch roller axle in the first pinch roller set.

4. The printing apparatus according to claim 1, wherein supports are provided on either end of the pinch roller axle in the second pinch roller set.

5. The printing apparatus according to claim 1, wherein supports in the second pinch roller set are provided at the portion between the two pinch rollers disposed at the end of the pinch roller axle closer to the center in the widthwise direction of the sheet and outward in the widthwise direction of the sheet.

6. The printing apparatus according to claim 1, wherein the second pinch roller set is disposed at the non-reference end in the widthwise direction of the sheet in the case where the conveying mechanism takes one end in the widthwise direction of the sheet as a conveying reference end.

7. The printing apparatus according to claim 1, wherein the pinch rollers are formed of plastic or compounds of plastic and rubber, and the pinch roller axles are formed of a metal material.

8. The printing apparatus according to claim 1, wherein the pinch rollers and the pinch roller axle in the first pinch roller set and the second pinch roller set are integrally formed out of plastic or metal.

9. The printing apparatus according to claim 1, wherein the urging mechanism includes a plurality of metal elastic members all having the same structure.

10. The printing apparatus according to claim 1, wherein the pressing force exerted on the conveying roller by the pinch roller disposed farthest outward in the widthwise direction of the sheet from among the three pinch rollers in the second pinch roller set is less than the respective pressing forces exerted on the conveying roller by the two pinch rollers disposed closer to the center in the widthwise direction of the sheet from among the three pinch rollers.

11. A printing apparatus, comprising:

a conveying mechanism that includes a conveying roller being a driving roller, a plurality of pinch rollers being passive rollers disposed facing the conveying roller, and a plurality of pinch roller axles supporting the pinch rollers; and a print unit that prints onto a sheet conveyed by the conveying rollers and the plurality of pinch rollers, wherein the conveying mechanism further comprises a first pinch roller set including two pinch rollers and a first pinch roller axle supporting the two pinch rollers, and second pinch roller sets each including three pinch rollers and a second pinch roller axle supporting the three pinch rollers, wherein the pinch rollers all have the same structures; and wherein one of the second pinch roller sets is disposed at each end in the widthwise direction of the sheet.

12. A printing apparatus, comprising:

a conveying mechanism that includes a conveying roller being a driving roller, a plurality of pinch rollers being passive rollers disposed facing the conveying roller, and a plurality of pinch roller axles supporting the pinch rollers; and a print unit that prints onto a sheet conveyed by the conveying rollers and the plurality of pinch rollers, wherein the conveying mechanism comprises a first pinch roller set including two pinch rollers and a first pinch roller axle supporting the two pinch rollers, a second pinch roller set including three pinch rollers and a second pinch roller axle supporting the three pinch rollers, and a pinch roller axle support mechanism including supports that rotatably support two sides on the first and second pinch roller axles, respectively, in the sheet conveying direction, and a contact portion that contacts each of the pinch roller axles at a portion between the plurality of pinch rollers, and wherein an urging unit urges the contact portion so as to push the pinch rollers towards the conveying roller via the pinch roller axles, and wherein the pinch rollers all have the same structures, and one pinch roller disposed most outward in the widthwise direction of the sheet among the three pinch rollers in the second pinch roller set is disposed within 50 mm of the contact portion.

13. A conveying mechanism comprising:

a conveying roller being a driving roller for conveying a sheet;

a plurality of a first pinch roller assembly for urging the sheet to the conveying roller, wherein the first pinch roller assembly includes two pinch rollers and a first pinch roller axle supporting the two pinch rollers, a plurality of a second pinch roller assembly for urging the sheet to the conveying roller, wherein the second pinch roller assembly includes three pinch rollers and a second pinch roller axle supporting the three pinch rollers; and wherein the pinch rollers all have the same structures; and an urging unit configured to urge a portion of each second pinch roller axle so as to push the three pinch rollers towards the conveying roller via the second pinch roller axle, wherein said portion of the second pinch roller axle is between two pinch rollers of the three rollers and is disposed closer to the center in the widthwise direction of the sheet from among the three pinch rollers.

14. The conveying mechanism according claim 13, further comprising a pinch roller axle support mechanism including a contact portion that contacts the second pinch roller axle at a portion between the two pinch rollers disposed closer to the center in the widthwise direction of the sheet from among the three pinch rollers.

* * * * *